US009883741B2

(12) United States Patent
Demasi, III

(10) Patent No.: US 9,883,741 B2
(45) Date of Patent: Feb. 6, 2018

(54) FOLDABLE STEP SYSTEM

(71) Applicant: Vincent Demasi, III, Hillsborough, NJ (US)

(72) Inventor: Vincent Demasi, III, Hillsborough, NJ (US)

( * ) Notice: Subject to any disclaimer, the term of this patent is extended or adjusted under 35 U.S.C. 154(b) by 0 days.

(21) Appl. No.: 15/144,405

(22) Filed: May 2, 2016

(65) Prior Publication Data

US 2017/0311714 A1 Nov. 2, 2017

(51) Int. Cl.

| | |
|---|---|
| ***E06C 9/00*** | (2006.01) |
| ***A47B 46/00*** | (2006.01) |
| ***A47B 77/10*** | (2006.01) |
| ***A47B 97/00*** | (2006.01) |

(52) U.S. Cl.

CPC ..... *A47B 46/005* (2013.01); *A47B 77/10* (2013.01); *A47B 97/00* (2013.01); *A47B 2220/05* (2013.01)

(58) Field of Classification Search

CPC ..... A47B 2220/05; A47B 77/10; A47B 9/00; A47B 9/06; E06C 1/005; E06C 9/06; E06C 9/08; E06C 9/085

USPC ..... 312/321.5, 317.3, 235.1, 235.2, 235.3, 312/235.5, 313, 314; 108/48, 33, 36, 35

See application file for complete search history.

(56) References Cited

U.S. PATENT DOCUMENTS

| | | | | |
|---|---|---|---|---|
| 2,581,488 A | | 1/1952 | Keltner | |
| 3,030,166 A | | 4/1962 | Richards et al. | |
| 3,136,386 A | | 6/1964 | Horvath et al. | |
| 4,155,609 A | * | 5/1979 | Skafte | A47B 85/08 108/48 |
| 5,031,975 A | * | 7/1991 | Anderson | A47J 47/005 108/20 |
| 5,131,492 A | | 7/1992 | Caminiti et al. | |
| 5,586,816 A | * | 12/1996 | Geiss, II | A47B 51/00 312/301 |
| 5,967,255 A | | 10/1999 | Young | |
| 6,371,584 B1 | * | 4/2002 | Alreck | A47B 67/04 177/144 |
| D527,919 S | | 9/2006 | Sutton | |
| 9,030,827 B2 | * | 5/2015 | Jau | G06F 1/16 211/49.1 |
| 9,629,454 B2 | * | 4/2017 | Bunch | A47B 46/005 |
| 2002/0109446 A1 | * | 8/2002 | Arnold | A47B 83/00 312/319.5 |
| 2007/0018545 A1 | * | 1/2007 | Calabria | A47B 77/10 312/311 |
| 2008/0264723 A1 | * | 10/2008 | Tatum | A47C 12/00 182/35 |
| 2010/0308615 A1 | * | 12/2010 | Miles | A47B 77/10 296/37.8 |

(Continued)

FOREIGN PATENT DOCUMENTS

| | | | | |
|---|---|---|---|---|
| CA | 2781574 A1 | * | 8/2011 | E06C 5/02 |
| DE | 102007045215 A1 | * | 4/2009 | A47B 77/10 |

*Primary Examiner* — Jerry Redman

(57) ABSTRACT

A foldable step system includes a cabinet that has a door. A step unit is hingedly coupled to the door. The step unit is positioned in a deployed position when the door is positioned in an open position. Thus, the step unit may support a user thereby facilitating the user to reach an elevated object. The step unit is positioned in a stored position such that the door may be positioned in a closed position. A drive is movably coupled to the step unit such that the drive selectively positions the step unit in the deployed position.

11 Claims, 5 Drawing Sheets

(56) References Cited

U.S. PATENT DOCUMENTS

| | | | | |
|---|---|---|---|---|
| 2011/0214942 | A1* | 9/2011 | Niemiec | E04G 3/00 182/19 |
| 2011/0266936 | A1* | 11/2011 | Moran | A47B 51/00 312/312 |
| 2013/0213738 | A1* | 8/2013 | Schroeder | E06C 9/06 182/90 |
| 2015/0001005 | A1 | 1/2015 | Goodson | |
| 2015/0033786 | A1* | 2/2015 | Mansfield | F25D 23/12 62/449 |
| 2015/0250306 | A1* | 9/2015 | Bunch | A47B 46/005 312/248 |
| 2016/0166058 | A1* | 6/2016 | Bunch | A47B 46/005 312/249.7 |

* cited by examiner

FOLDABLE STEP SYSTEM

BACKGROUND OF THE DISCLOSURE

Field of the Disclosure

The disclosure relates to step devices and more particularly pertains to a new step device for facilitating a foldable step coupled to a cabinet door.

SUMMARY OF THE DISCLOSURE

An embodiment of the disclosure meets the needs presented above by generally comprising a cabinet that has a door. A step unit is hingedly coupled to the door. The step unit is positioned in a deployed position when the door is positioned in an open position. Thus, the step unit may support a user thereby facilitating the user to reach an elevated object. The step unit is positioned in a stored position such that the door may be positioned in a closed position. A drive is movably coupled to the step unit such that the drive selectively positions the step unit in the deployed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
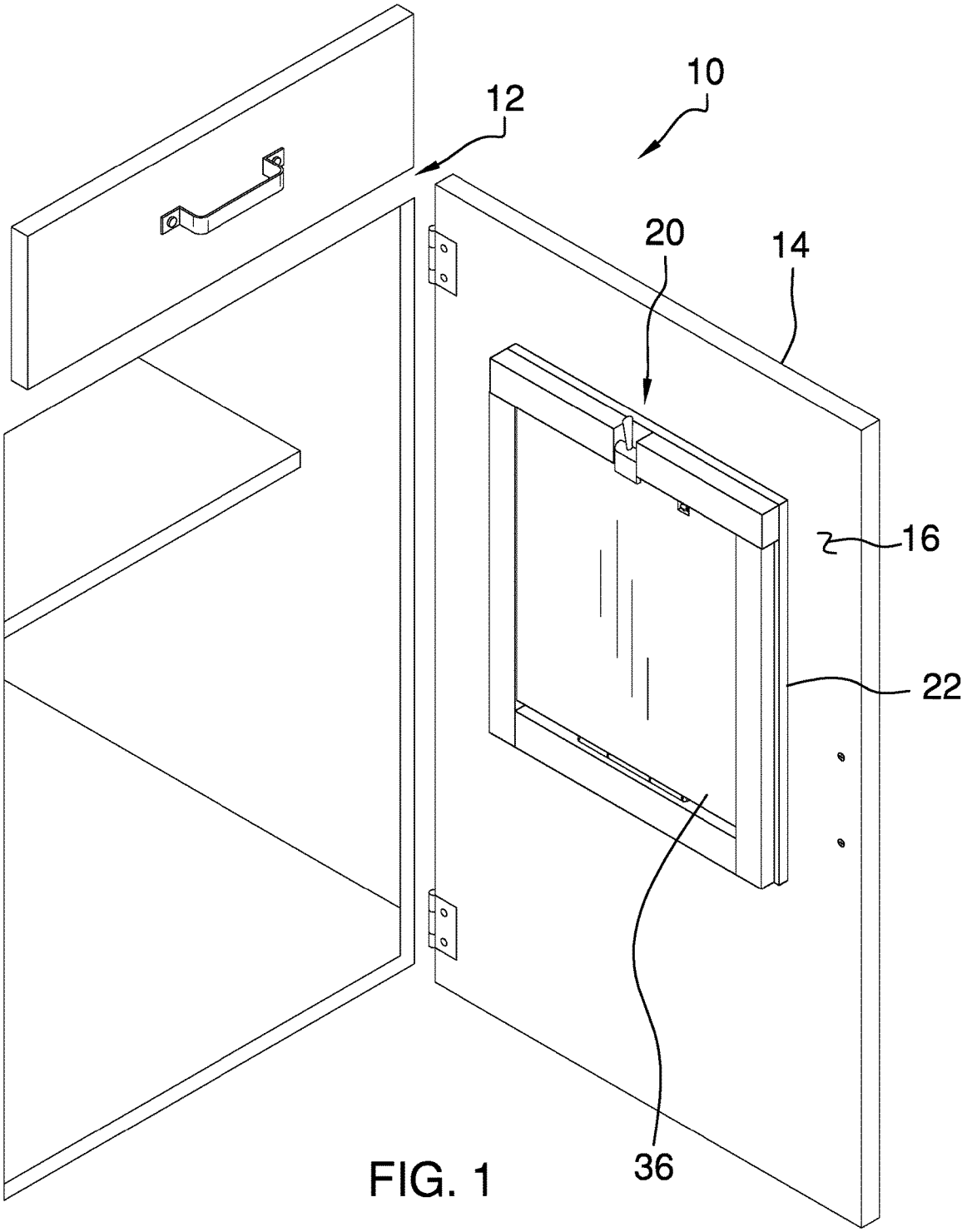
FIG. 1 is a front perspective view of a foldable step system according to an embodiment of the disclosure.
Figure 2:
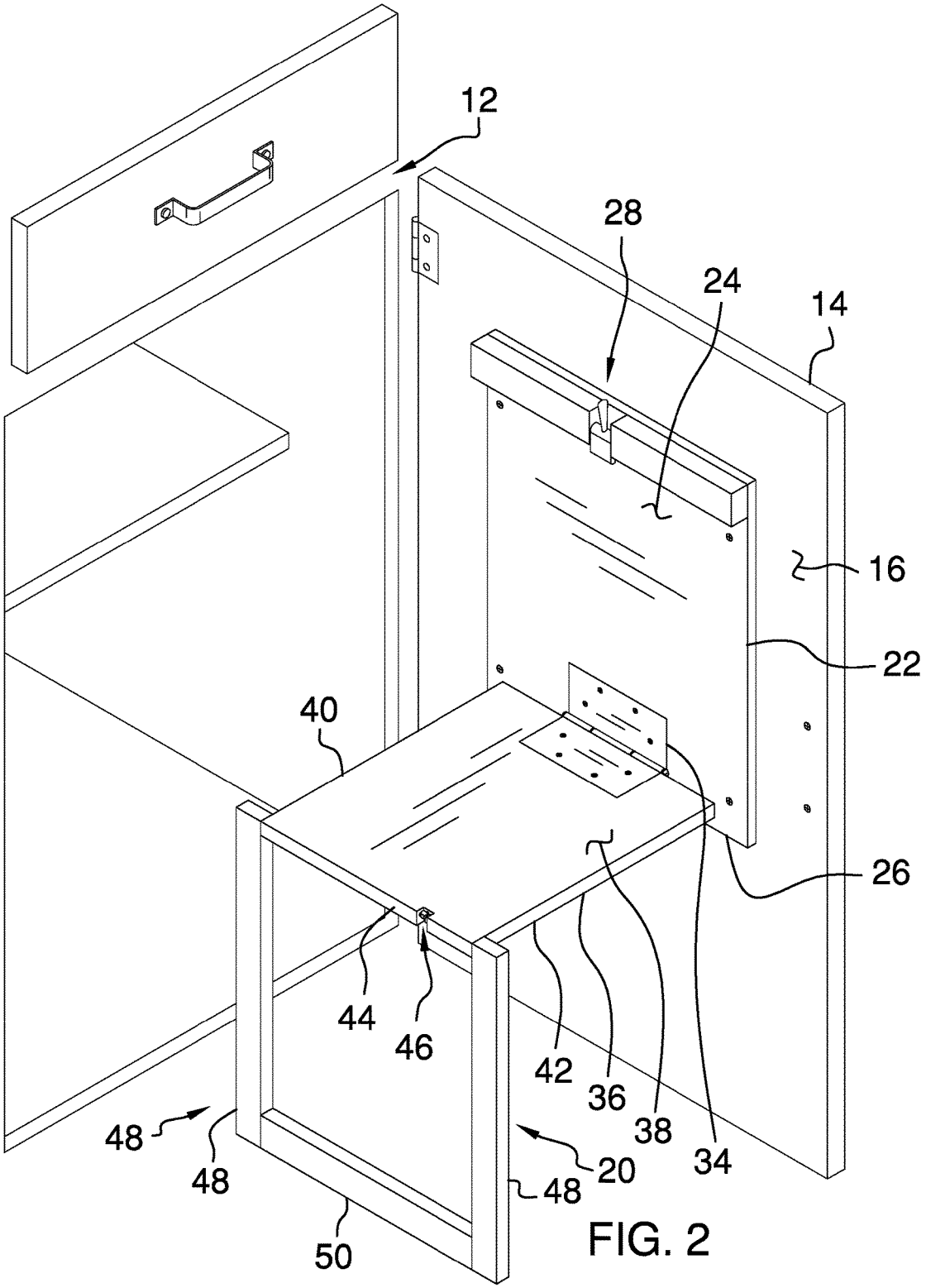
FIG. 2 is a perspective in-use view of an embodiment of the disclosure.
Figure 3:
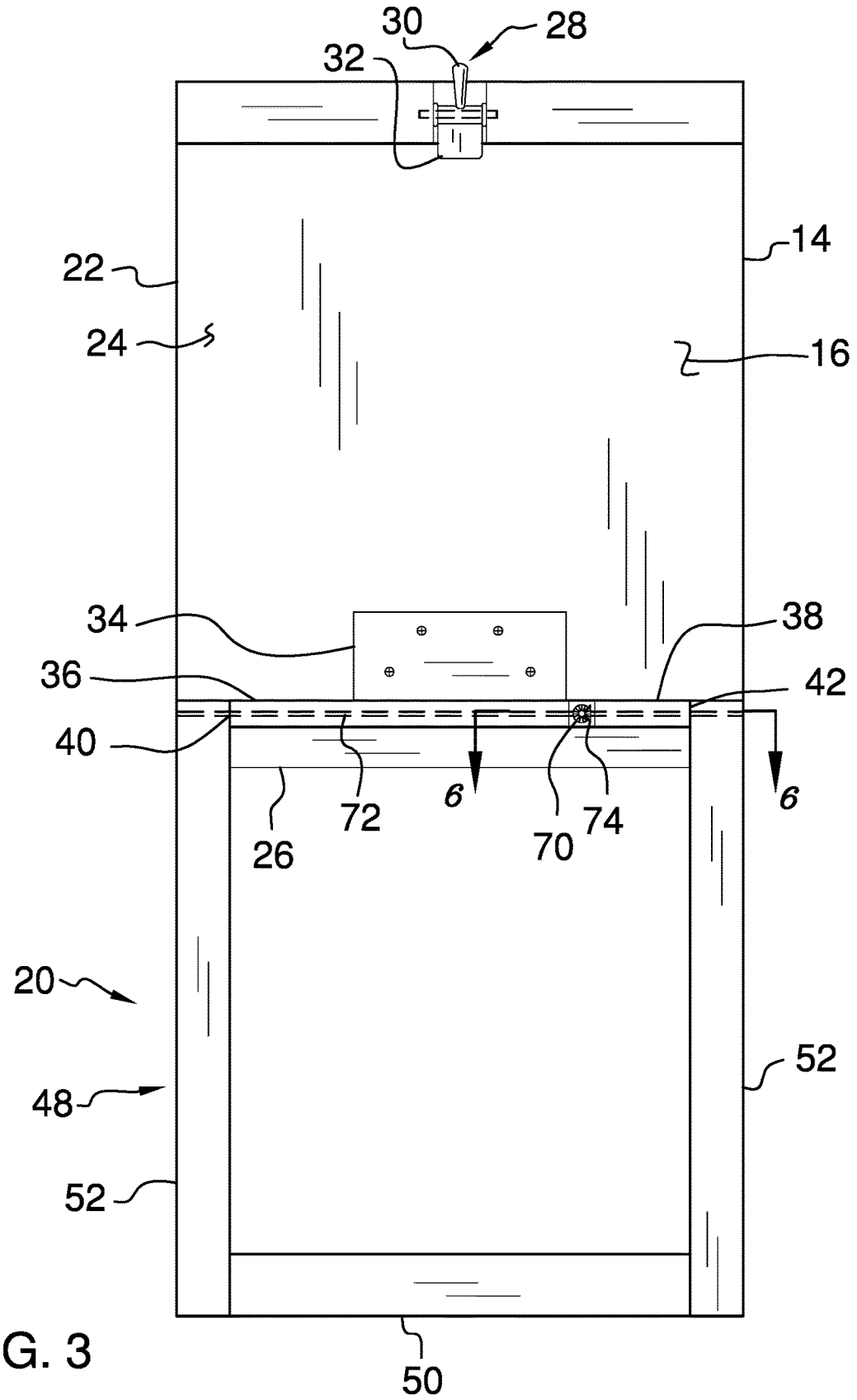
FIG. 3 is a front view of an embodiment of the disclosure.
Figure 4:
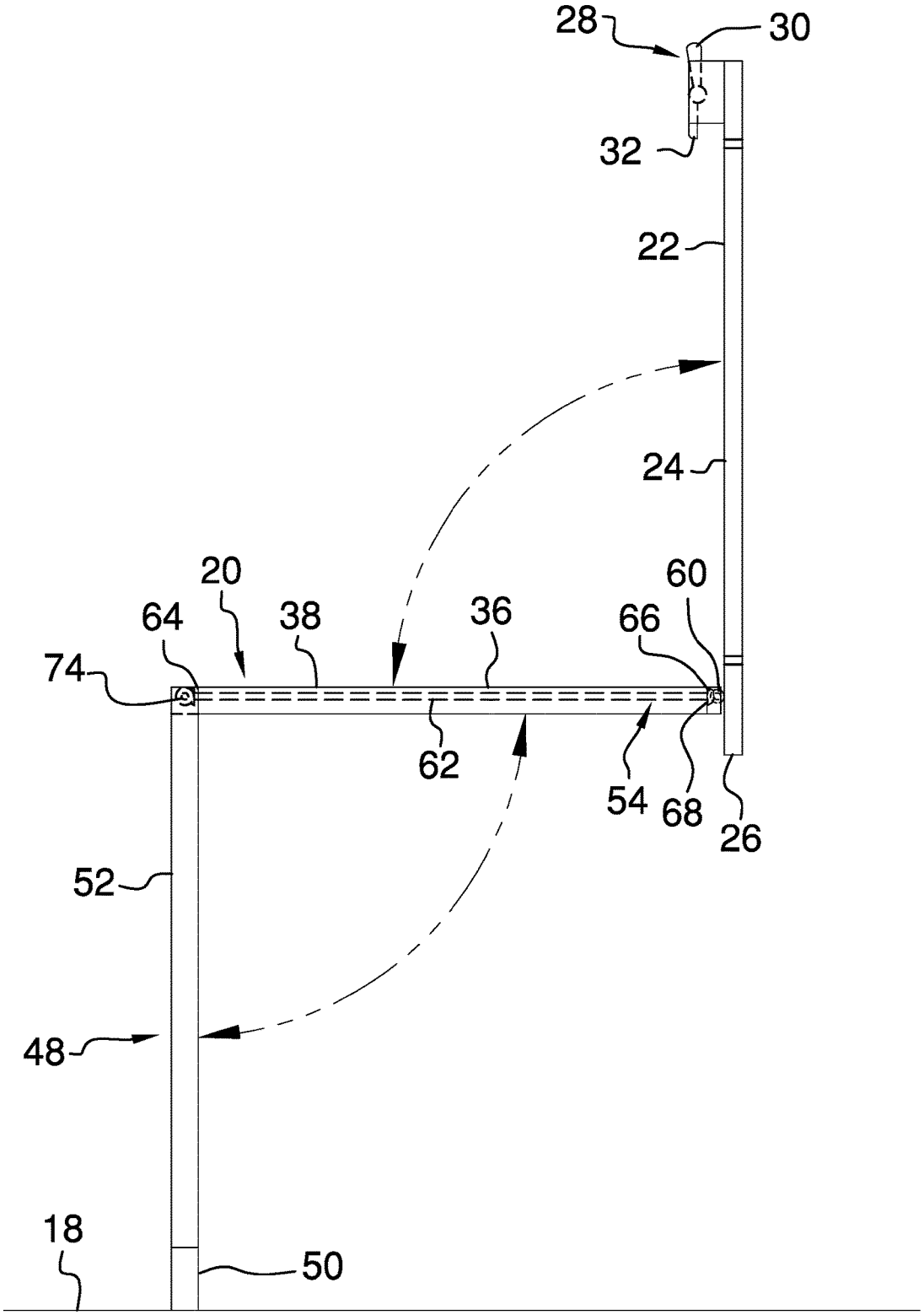
FIG. 4 is a left side view of an embodiment of the disclosure.
Figure 6:
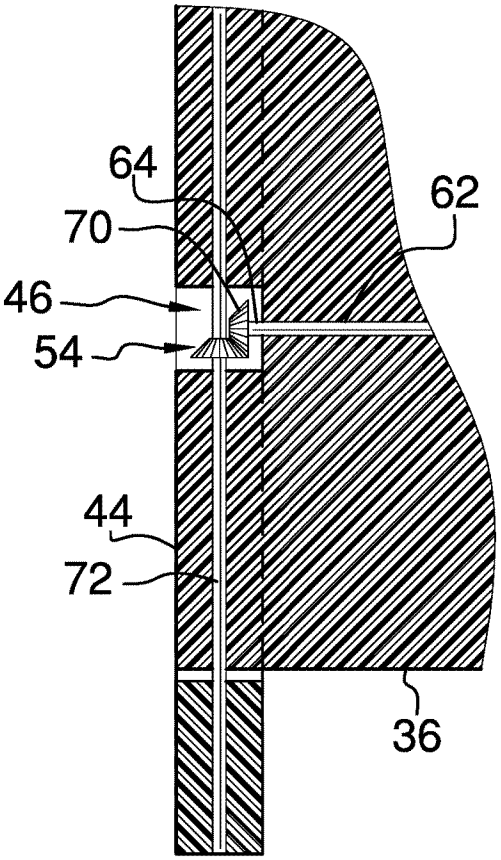
FIG. 6 is a cross sectional view taken along line 6-6 of FIG. 3 of an embodiment of the disclosure.
Figure 5:
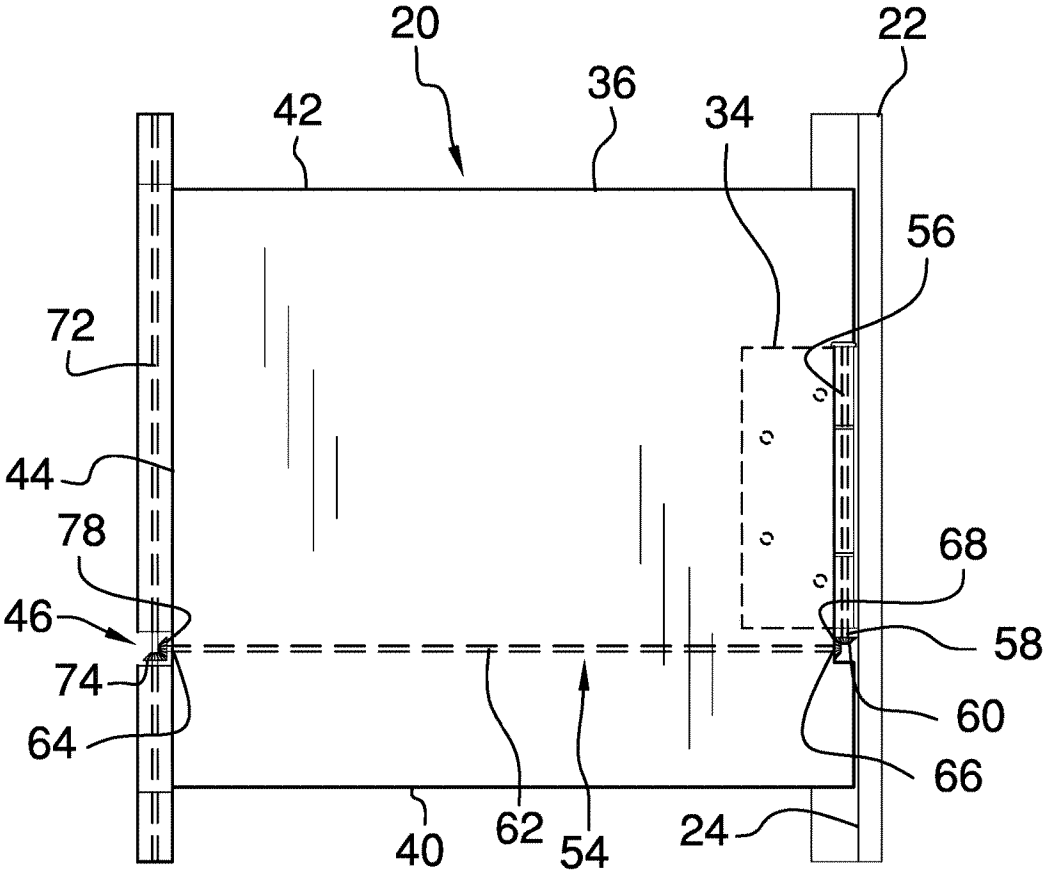
FIG. 5 is a bottom phantom view of an embodiment of the disclosure.

With reference now to the drawings, and in particular to FIGS. 1 through 6 thereof, a new step device embodying the principles and concepts of an embodiment of the disclosure and generally designated by the reference numeral 10 will be described.

As best illustrated in FIGS. 1 through 6, the foldable step system 10 generally comprises a cabinet 12 that has a door 14. The door 14 has an inner surface 16. The cabinet 12 may be positioned on a support surface 18. The support surface 18 may be a floor or the like.

A step unit 20 is provided and the step unit 20 is hingedly coupled to the door 14. The step unit 20 is positioned in a deployed position when the door 14 is positioned in an open position. Thus, the step unit 20 may support a user thereby facilitating the user to reach an elevated object. The step unit 20 is positioned in a stored position thereby facilitating the door 14 to be positioned in a closed position.

The step unit 20 comprises a first panel 22 that is coupled to the inner surface 16 of the door 14. The first panel 22 has an exposed surface 24 with respect to the door 14 and a lower edge 26. A lock 28 is coupled to the exposed surface 24 and the lock 28 may be manipulated. The lock 28 may include a lever 30 and a plate 32. The plate 32 may be hingedly coupled to the exposed surface 24 and the lever 32 may be coupled to the plate 32.

A hinge 34 is provided. The hinge 34 is coupled to the exposed surface 24 of the first panel 22. The hinge 34 is positioned adjacent to the lower edge 26. The hinge 34 may comprise a spring loaded hinge or the like.

A second panel 36 is provided and the second panel 36 has a first surface 38, a first lateral edge 40 and a second lateral edge 42. The second panel 36 is coupled to the hinge 34 such that the second panel 36 has a distal edge 44 with respect to the first panel 22. The second panel 36 is positionable in a stored position having the first surface 38 abutting the exposed surface 24 of the first panel 22. The second panel 36 is positionable in a deployed position having the second panel 36 is oriented perpendicular to the first panel 46. Thus, the first surface 22 may support the user.

The lock 28 engages the distal edge 44 when the second panel 36 is positioned in the stored position. The plate 32 may frictionally engage the second panel 36 when the second panel 36 is positioned in the stored position. The lock 28 selectively disengages the second panel 36 such that the second panel 36 is positionable in the deployed position. The distal edge 44 of the second panel 36 has a notch 46 extending inwardly toward the hinge. The lever 32 may be manipulated to facilitate the lock 28 to engage and disengage the second panel 36.

A support 48 is provided. The support 48 includes a central member 50 extending between a pair of lateral members 52. The lateral members 52 are spaced apart from each other. Each of the lateral members 52 is hingedly coupled to an associated one of the first lateral edge 40 and the second lateral edge 42 of the second panel 36.

The support 48 is positionable in a deployed position when the second panel 36 is positioned in the deployed position. Each of the lateral members 52 extends downwardly from the second panel 36. Thus, the central member 50 abuts the support surface 18 thereby facilitating the second panel 36 to support the user. The support 48 is positionable in a stored position when the second panel 36 is positioned in the stored position. The support 48 frames the second panel 36 when the support 48 is in the stored position.

A drive 54 is provided. The drive 54 comprises a first shaft 56 that extends laterally through the hinge 34. The hinge 34 rotates the first shaft 56 in a first direction when the second panel 36 is positioned in the deployed position. The hinge 34 rotates the first shaft 54 in a second direction when the second panel 36 is positioned in the stored position. The first shaft 56 has a first end 58 and the first end 58 extends outwardly from the hinge 34.

A first gear 60 is coupled to the first end 58 such that first shaft 56 rotates the first gear 60 in the first direction and the second direction. A second shaft 62 is rotatably positioned within the second panel 36. The second shaft 62 has a primary end 64 and a secondary end 66. The secondary end 66 is aligned with the hinge 34. The primary end 64 is aligned with the notch 46 in the second panel 36.

A second gear 68 is coupled to the secondary end 66 of the second shaft 62 and the second gear 68 engages the first gear 60. The second shaft 62 rotates in the first direction when the first shaft 56 is rotated in the first direction. The second shaft 62 rotates in the second direction when the first shaft 56 is rotated in the second direction. A third gear 70 is coupled to the primary end 64 and the third gear 70 is positioned in the notch 34.

A third shaft 72 is rotatably positioned within the second panel 36 and the third shaft 72 is coextensive with the distal edge 44 of the second panel 36. The third shaft 72 is coupled to each of the lateral members 52 of the support 48. A fourth gear 74 is coupled to the third shaft 72 and the fourth gear 74 is positioned in the notch 34. The fourth gear 74 engages the third gear 70.

The third shaft 72 rotates in the first direction when the second shaft 62 rotates in the first direction. Thus, the third shaft 72 urges the support 48 into the deployed position when the second panel 36 is positioned in the deployed position. The third shaft 72 rotates in the second direction when the second shaft 62 rotates in the second direction. Thus, the support 48 is urged into the stored position when the second panel 36 is positioned in the stored position.

In use, the door 14 on the cabinet 12 is positioned in the open position. The lock 28 is manipulated to release the second panel 36. The hinge 34 urges the second panel 36 into the deployed position and the hinge 34 rotates the first shaft 56 in the first direction. The first shaft 56 rotates the second shaft 62 in the first direction. The second shaft 62 rotates the third shaft 72 in the first direction. The third shaft 72 urges the support 48 into the deployed position. Thus, the support 48 abuts the support surface 18 thereby facilitating the second panel 36 to support the user.

The second panel 36 is manually urged into the stored position. The hinge 34 rotates the first shaft 56 in the second direction. The second shaft 62 rotates the third shaft 72 in the second direction. The third shaft 72 urges the support into the stored position. The lock 28 engages the second panel 36 to retain each of the second panel 36 and the support in the stored position.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A foldable step system comprising:

a cabinet having a door;

a step unit being hingedly coupled to said door, said step unit being positioned in a deployed position when said door is positioned in an open position wherein said step unit is configured to support a user thereby facilitating the user to reach an elevated object, said step unit being positioned in a stored position such that said door is positionable in a closed position; and a drive being movably coupled to said step unit such that said drive selectively positions said step unit in said deployed position;

said step unit including a hinge, a first panel and a second panel, said first panel being coupled to an inner surface of said door;

said drive comprising a first shaft being coupled to said hinge, said hinge rotating said first shaft in a first direction when said second panel is positioned in a deployed position, said hinge rotating said first shaft in a second direction when said second panel is positioned in a stored position, said first shaft having a first end, said first end extending outwardly from said hinge; and a first gear being coupled to said first end such that first shaft rotates said first gear in said first direction and said second direction.

2. The system according to claim 1, wherein said step unit comprises:

said first panel having an exposed surface with respect to said door and a lower edge;

a lock being coupled to said exposed surface wherein said lock is configured to be manipulated; and said hinge being coupled to said exposed surface of said first panel, said hinge being positioned adjacent to said lower edge.

3. The system according to claim 1, further comprising:

said second panel having a notch; and a second shaft being rotatably positioned within said second panel, said second shaft having a primary end and a secondary end, said secondary end being aligned with said hinge, said primary end being aligned with said notch in said second panel.

4. The system according to claim 3, further comprising a second gear being coupled to said secondary end of said second shaft, said second gear engaging said first gear, said second shaft rotating in said first direction when said first shaft is rotated in said first direction, said second shaft rotating in said second direction when said first shaft is rotated in said second direction.

5. The system according to claim 4, further comprising a third gear being coupled to said primary end such that said third gear is positioned in said notch.

6. The system according to claim 5, further comprising a third shaft being rotatably positioned within said second panel, said third shaft being coextensive with said distal edge of said second panel, said third shaft being coupled to each of said lateral members of said support.

7. The system according to claim 6, further comprising:

a support; and a fourth gear being coupled to said third shaft such that said fourth gear is positioned in said notch, said fourth gear engaging said third gear, said third shaft rotating in said first direction when said second shaft rotates in said first direction such that said third shaft urges said support into a deployed position when said second panel is positioned in said deployed position, said third shaft rotating in said second direction when said second shaft rotates in said second direction such that said support is urged into a stored position when said second panel is positioned in said stored position.

8. A foldable step system comprising:

a cabinet having a door;

a step unit being hingedly coupled to said door, said step unit being positioned in a deployed position when said door is positioned in an open position wherein said step unit is configured to support a user thereby facilitating the user to reach an elevated object, said step unit being positioned in a stored position such that said door is positionable in a closed position;

a drive being movably coupled to said step unit such that said drive selectively positions said step unit in said deployed position; and wherein said step unit comprises a first panel being coupled to an inner surface of said door, said first panel having an exposed surface with respect to said door and a lower edge, a lock being coupled to said exposed surface wherein said lock is configured to be manipulated, a hinge being coupled to said exposed surface of said first panel, said hinge being positioned adjacent to said lower edge, and a second panel having a first surface, a first lateral edge and a second lateral edge, said second panel being coupled to said hinge such that said second panel has a distal edge with respect to said first panel, said second panel being positionable in a stored position having said first surface abutting said exposed surface of said first panel, said lock engaging said distal edge when said second panel is positioned in said stored position, said lock selectively disengaging said second panel such that said second panel is positionable in a deployed position having said second panel being oriented perpendicular to said first panel wherein said first surface is configured to support the user, said distal edge having a notch extending inwardly toward said hinge.

9. The system according to claim 8, further comprising a support having a central member extending between a pair of lateral members, said lateral members being spaced apart from each other, each of said lateral members being hingedly coupled to an associated one of said first lateral edge and said second lateral edge of said second panel.

10. The system according to claim 9, wherein said support is positionable in a deployed position when said second panel is positioned in said deployed position having each of said lateral members extending downwardly from said second panel wherein said central member is configured to abut a support surface thereby facilitating said second panel to support the user, said support being positionable in a stored position when said second panel is positioned in said stored position having said support framing said second panel.

11. A foldable step system comprising:

a cabinet having a door, said door having an inner surface;

a step unit being hingedly coupled to said door, said step unit being positioned in a deployed position when said door is positioned in an open position wherein said step unit is configured to support a user thereby facilitating the user to reach an elevated object, said step unit being positioned in a stored position such that said door is positionable in a closed position, said step unit comprising:

a first panel being coupled to said inner surface of said door, said first panel having an exposed surface with respect to said door and a lower edge, a lock being coupled to said exposed surface wherein said lock is configured to be manipulated, a hinge being coupled to said exposed surface of said first panel, said hinge being positioned adjacent to said lower edge, a second panel having a first surface, a first lateral edge and a second lateral edge, said second panel being coupled to said hinge such that said second panel has a distal edge with respect to said first panel, said second panel being positionable in a stored position having said first surface abutting said exposed surface of said first panel, said lock engaging said distal edge when said second panel is positioned in said stored position, said lock selectively disengaging said second panel such that said second panel is positionable in a deployed position having said second panel being oriented perpendicular to said first panel wherein said first surface is configured to support the user, said distal edge having a notch extending inwardly toward said hinge, and a support having a central member extending between a pair of lateral members, said lateral members being spaced apart from each other, each of said lateral members being hingedly coupled to an associated one of said first lateral edge and said second lateral edge of said second panel, said support being positionable in a deployed position when said second panel is positioned in said deployed position having each of said lateral members extending downwardly from said second panel wherein said central member is configured to abut a support surface thereby facilitating said second panel to support the user, said support being positionable in a stored position when said second panel is positioned in said stored position having said support framing said second panel; and a drive being movably coupled to said step unit such that said drive selectively positions said step unit in said deployed position, said drive comprising:

a first shaft being coupled to said hinge, said hinge rotating said first shaft in a first direction when said second panel is positioned in said deployed position, said hinge rotating said first shaft in a second direction when said second panel is positioned in said stored position, said first shaft having a first end, said first end extending outwardly from said hinge, a first gear being coupled to said first end such that first shaft rotates said first gear in said first direction and said second direction, a second shaft being rotatably positioned within said second panel, said second shaft having a primary end and a secondary end, said secondary end being aligned with said hinge, said primary end being aligned with said notch in said second panel, a second gear being coupled to said secondary end of said second shaft, said second gear engaging said first gear, said second shaft rotating in said first direction when said first shaft is rotated in said first direction, said second shaft rotating in said second direction when said first shaft is rotated in said second direction, a third gear being coupled to said primary end such that said third gear is positioned in said notch, a third shaft being rotatably positioned within said second panel, said third shaft being coextensive with said distal edge of said second panel, said third shaft being coupled to each of said lateral members of said support, and a fourth gear being coupled to said third shaft such that said fourth gear is positioned in said notch, said fourth gear engaging said third gear, said third shaft rotating in said first direction when said second shaft rotates in said first direction such that said third shaft urges said support into said deployed position when said second panel is positioned in said deployed position, said third shaft rotating in said second direction when said second shaft rotates in said second direction such that said support is urged into said stored position when said second panel is positioned in said stored position.

* * * * *